US008695966B2

(12) United States Patent
Tsai et al.

(10) Patent No.: US 8,695,966 B2
(45) Date of Patent: Apr. 15, 2014

(54) PAPER RETRIEVING MECHANISM

(75) Inventors: Kung-Huang Tsai, New Taipei (TW); Ching-Wei Chen, New Taipei (TW); Shih-Wei Cheng, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 221 days.

(21) Appl. No.: 13/193,616

(22) Filed: Jul. 29, 2011

(65) Prior Publication Data

US 2012/0315122 A1 Dec. 13, 2012

(30) Foreign Application Priority Data

Jun. 8, 2011 (TW) ..... 100120055 A

(51) Int. Cl.
*B65H 1/00* (2006.01)

(52) U.S. Cl.
USPC ..... 271/145; 271/222

(58) Field of Classification Search
USPC ..... 271/145, 147, 164, 207, 213, 220, 223, 271/221, 222
See application file for complete search history.

(56) References Cited

U.S. PATENT DOCUMENTS 6,505,830 B2 * 1/2003 Kang ..... 271/223

* cited by examiner

*Primary Examiner* — Michael McCullough
(74) *Attorney, Agent, or Firm* — Altis Law Group, Inc.

(57) ABSTRACT

A paper retrieving mechanism includes a base, a handle movably connected to the base, and a resisting element. The base supports an amount of paper, and defines a first slot. The paper is to be placed over the first slot. The resisting element passes through the first slot, and is connected to the handle. The handle is to be acted upon by an external force to drive the resisting element to move along the first slot to push the paper to move relative to the base.

5 Claims, 5 Drawing Sheets

PAPER RETRIEVING MECHANISM

BACKGROUND

1. Technical Field

The present disclosure relates to paper retrieving mechanisms and, particularly, to a paper retrieving mechanism for a printer.

2. Description of Related Art

Printers usually include a paper tray for placing an amount of paper to be used when printing. After printing, a user might want to remove the remaining paper from the paper tray. However, because the size of the space of the paper tray usually matches that of the paper, it is inconvenient for user to remove the paper from the paper tray.

Therefore, what is needed is a paper retrieving mechanism to overcome the described limitations.

DETAILED DESCRIPTION

Figure 1:
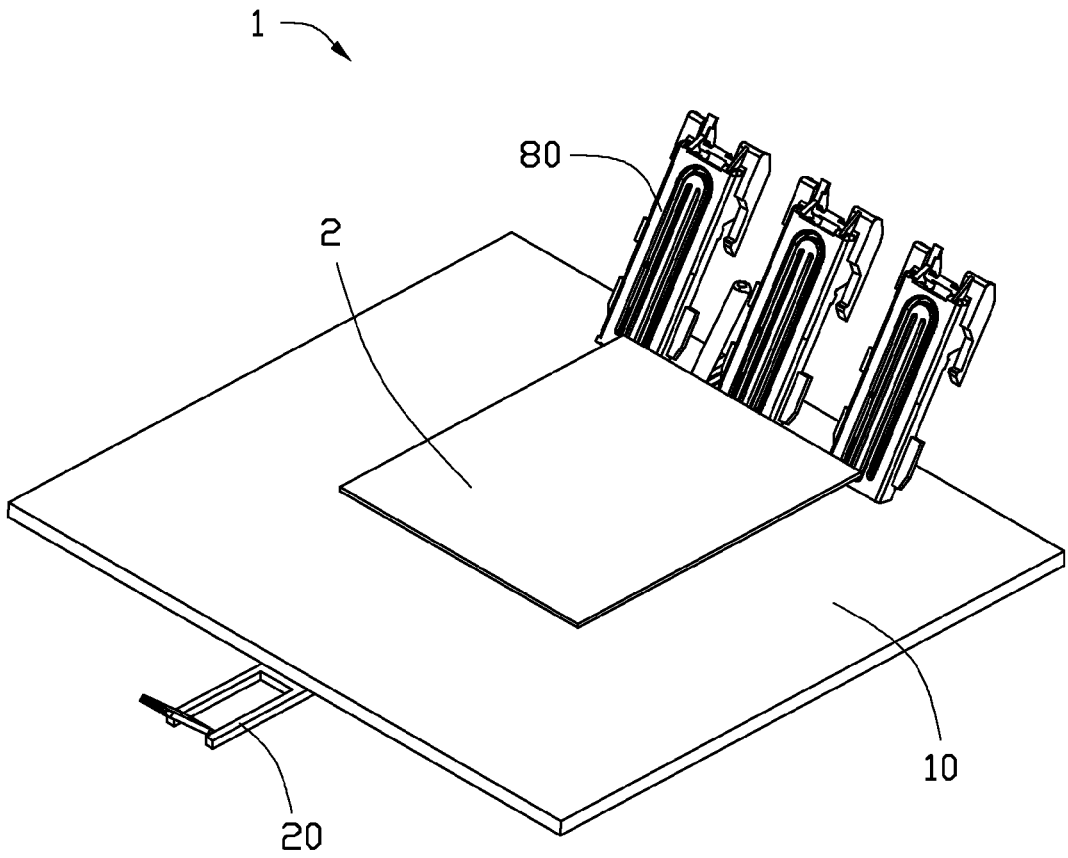
FIG. 1 is an isometric view of a paper retrieving mechanism, in accordance with an exemplary embodiment.
Figure 2:
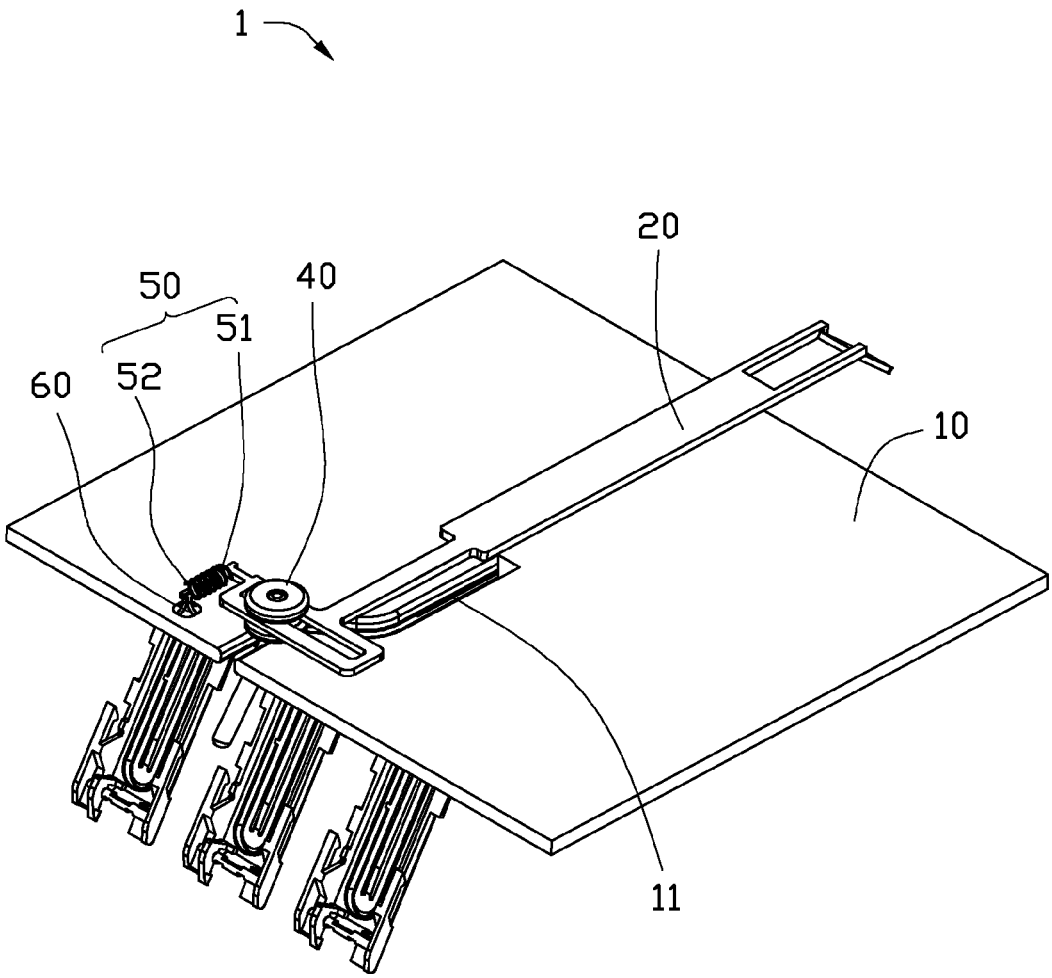
FIG. 2 is another isometric view of the paper retrieving mechanism of FIG. 1, viewed from another aspect.

Referring to FIGS. 1-2, a paper retrieving mechanism 1 is provided. The paper retrieving mechanism 1 is used to retrieve an amount of paper 2 from a printer, this has not been used by a user. The paper retrieving mechanism 1 includes a base 10 for supporting an amount of paper 2 to be used. The base 10 defines a first slot 11. An amount of paper 2 is placed on the first slot 11.

The paper retrieving mechanism 1 further includes a handle 20 placed below the base 10, and a resisting element 40 connected to the handle 20. The resisting element 40 passes through the first slot 11. When the handle 20 is to be acted upon by an external force to move away from the first slot 11. The resisting element 40 is driven to move with the movement of the handle 20 to push the paper 2 along the first slot 11 until the portion of the paper 2 on the first slot 11 is pushed out of the base 10, thereby providing convenience for the user to remove the paper.

The paper retrieving mechanism 1 further includes an elastic element 50. A first end 51 of the elastic element 50 is connected to the handle 20, and a second end 52 of the elastic element 50 is connected to one end of the base 10 adjacent to the first slot 11. When the handle 20 is forced by the external force to move away from the first slot 11, the elastic element 50 is deformed. After the paper 20 is removed from the base 10, and the external force applied on the handle 20 is released, the elastic element 50 rebounds to drive the handle 20 and the resisting element 40 to return to an original position. In one embodiment, the elastic element 50 is a spring. In other embodiment, after the paper 20 is removed from the base 10, the user can push the handle 20 and the resisting element 40 to the original position. In order to better understand the disclosure, an exemplary embodiment is described in detail.

Figure 3:
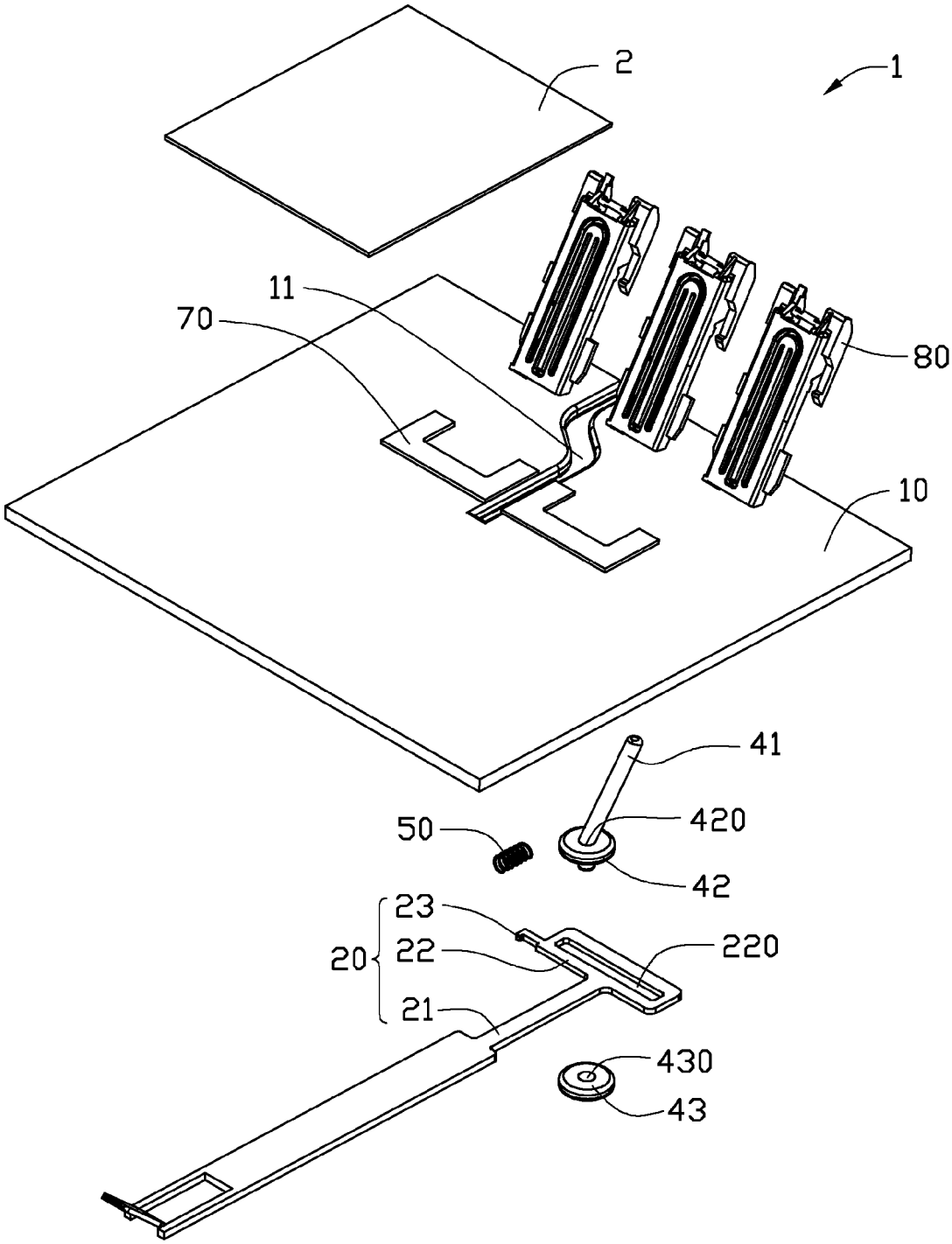
FIG. 3 is an exploded view of the paper retrieving mechanism of FIG. 1.

Referring to FIG. 3, the handle 20 includes a handle portion 21, a connection portion 22 connected to the handle portion 21, and an extension portion 23 extending from one end of the connection portion 22. The connection portion 22 defines a second slot 220. The user applies external force on the handle 20 by handling the handle portion 21.

The base 10 includes a protrusion 60 protruding from a bottom thereof. In one embodiment, the second end 52 of the elastic element 50 is connected to the protrusion 60, and the first end 51 is connected to the extension portion 23.

The resisting element 40 includes a resisting pole 41, a first fixing portion 42, and a second fixing portion 43. The first fixing portion 42 defines a first perforation 420, and the second fixing portion 43 defines a second perforation 430. The resisting pole 41 passes through the first slot 15, the first perforation 420, the second slot 220, and the second perforation 430, and is fixed on the second fixing portion 43, thereby slidably connecting the resisting element 40 to the handle 20.

The paper retrieving mechanism 1 further includes two opposite friction plates 70 mounted on the base 10, and at least two fixing blocks 80 mounted on the base 10. The amount paper 2 is placed on the friction plates 70. The two friction plates 70 increase the friction between the paper 2 and the base 10. The two fixing blocks 80 are in concert with the two friction plates 70 to prevent more than one piece of paper 2 from being used when printing. In one embodiment, the first slot 11 is defined between the two fixing blocks 80, and is curved. In other embodiment, the first slot 11 may be linear.

Figure 4:
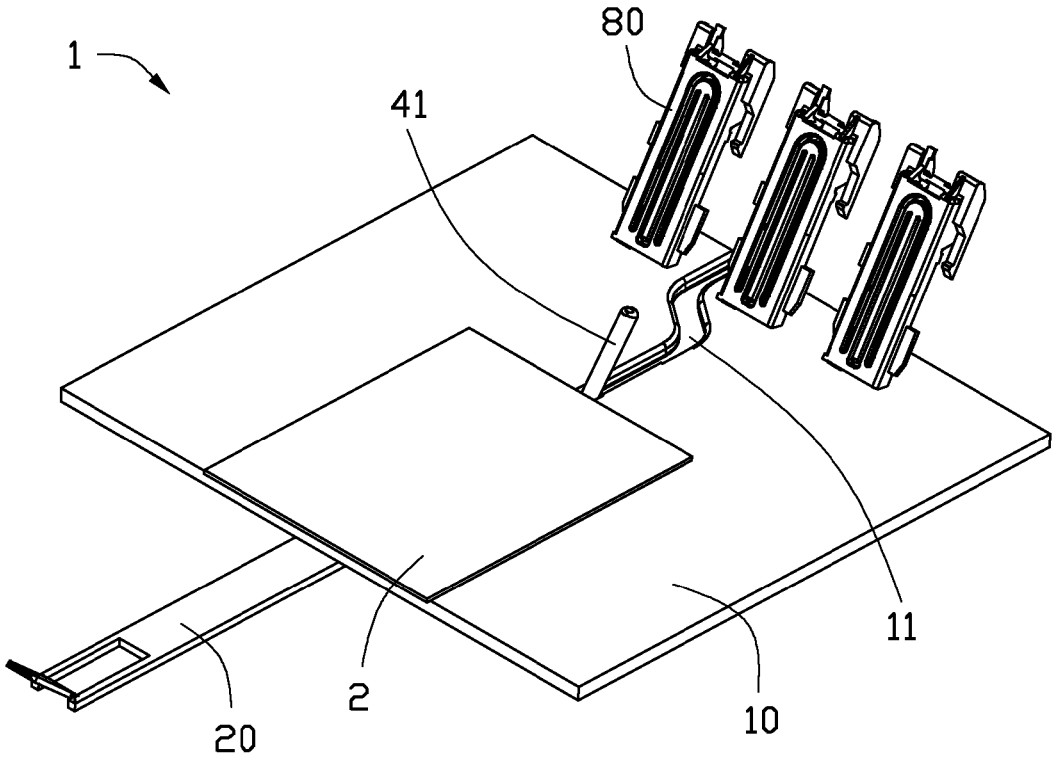
FIG. 4 shows paper being fetched from the paper retrieving mechanism of FIG. 1.
Figure 5:
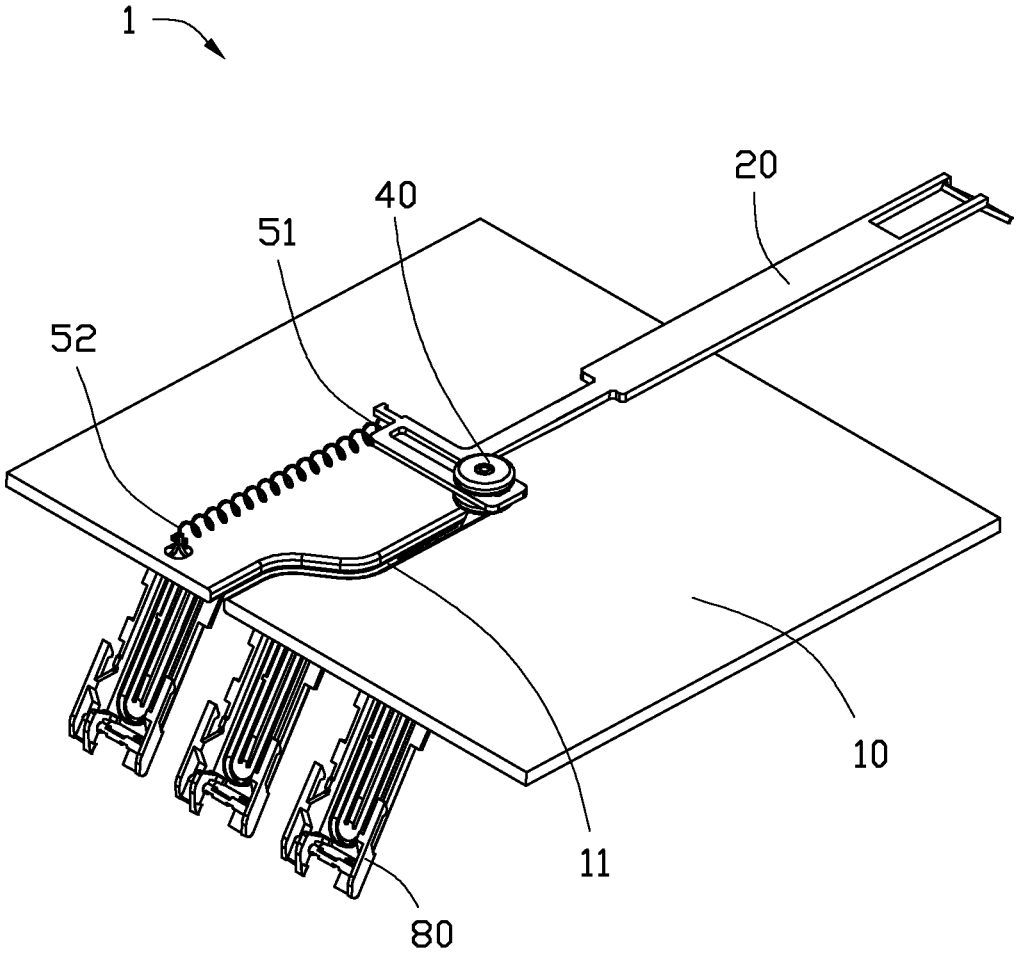
FIG. 5 shows a different perspective of the paper retrieving mechanism of FIG. 4.

Referring to FIGS. 4-5, to use the paper retrieving mechanism 1 to remove the paper 2 which is not being used, the handle portion 21 is forced by the external force to drive the handle 20 to move away from the first slot 11. The resisting pole 41 is driven by the connection portion 22 to move along the first slot 11 until an amount of the paper 2 is placed on the first slot 11 is pushed out of the base 10, thereby providing convenience for the user to remove the paper 2. During the movement of the resisting pole 41, because the first slot 11 is bent, the resisting pole 41 moves from one end of the connection portion 22 to another end of the connection portion 22. During the pushing out of the paper 2, the extension portion 23 deforms the elastic element 50.

After the paper 2 is removed from the base 10, the external force that applied on the handle 20 is released, the elastic element 50 rebounds to drive the handle 20 and the resisting element 40 to return to the original position.

Although the present disclosure has been specifically described on the basis of the embodiments thereof, the disclosure is not to be construed as being limited thereto. Various changes or modifications may be made to the embodiments without departing from the scope and spirit of the disclosure.

What is claimed is:

1. A paper retrieving mechanism comprising:

a base for supporting an amount of paper, and defining a first slot, wherein the paper is to be placed over the first slot;

a handle movably connected to the base;

a resisting element passing through the first slot, and connected to the handle;

an elastic element;

wherein the handle is to be acted upon by an external force to drive the resisting element to move along the first slot to push the paper to move relative to the base, the base comprises a protrusion protruding from a bottom thereof, a first end of the elastic element is connected to the handle, and a second end of the elastic element is connected to the protrusion; when the resisting element is driven by the handle to move along the first slot, the elastic element is deformed; after the external force applied on the handle is released, the elastic element rebounds to drive the handle and the resisting element to an original position.

2. The paper retrieving mechanism as described in claim 1, wherein the elastic element is a spring.

3. The paper retrieving mechanism as described in claim 1, wherein the handle comprises a handle portion, a connection portion connected to the handle portion, and an extension portion extending from one end of the connection portion, the first end of the elastic element is connected to the extension portion.

4. The paper retrieving mechanism as described in claim 3, wherein the resisting element comprises a resisting pole, a first fixing portion, and a second fixing portion, the first fixing portion defines a first perforation, the second fixing portion defines a second perforation, the connection portion defines a second slot, the resisting pole passes through the first slot, the first perforation, the second slot, and the second perforation, thereby connecting the resisting element to the handle.

5. The paper retrieving mechanism as described in claim 1, further comprising two opposite friction plates mounted on the base, wherein the portion of the amount of paper is placed on the two opposite friction plates, the two opposite friction plates are configured to increase the friction between the paper and the base.

* * * * *